US005505820A

United States Patent [19]

Donigian et al.

[11] Patent Number: 5,505,820

[45] Date of Patent: Apr. 9, 1996

[54] METHOD FOR PROVIDING ENHANCED SMOOTHNESS FOR A PAPER WEB

[75] Inventors: Douglas W. Donigian, Baltimore, Md.; Suzanne S. Fenton, Tolland, Conn.; Bryan J. Ortman, Beaumont, Tex.; Hiawatha P. Watkins, Columbia, Md.

[73] Assignee: Westvaco Corporation, New York, N.Y.

[21] Appl. No.: 371,206

[22] Filed: Jan. 11, 1995

[51] Int. Cl.[6] ..... D21F 11/00

[52] U.S. Cl. ..... 162/206; 162/201; 427/210; 100/93 RP; 100/38

[58] Field of Search ..... 162/201, 202, 162/203, 204, 205, 206, 210; 427/210, 211, 361; 100/93 RP, 38

[56] References Cited

U.S. PATENT DOCUMENTS

| | | | |
|---|---|---|---|
| 3,124,504 | 3/1964 | Mahoney et al. | 162/206 |
| 3,647,618 | 3/1972 | Back et al. | 162/205 |
| 3,647,619 | 4/1972 | Mack et al. | 162/206 |
| 4,596,633 | 6/1986 | Attwood | 162/206 |
| 5,316,624 | 5/1994 | Racine | 162/205 |
| 5,378,497 | 1/1995 | Johnson | 427/211 |

FOREIGN PATENT DOCUMENTS 522196 9/1938 United Kingdom .

OTHER PUBLICATIONS

"The Hydra–Nip Dryer: The Easy Way to Surface Smoothness", by M. Foulger, Tappi Journal, Sep. 1988, pp. 73–76.

*Primary Examiner*—David L. Lacey
*Assistant Examiner*—Jose A. Fortuna

[57] ABSTRACT

A paper rawstock web is wet densified on a papermachine at a moisture content greater than about 20% and less than about 50%, and preferably from about 25–35%, in a calender device at nip pressures greater than about 3000 psi, and preferably within the range of from about 3000–6000 psi, to provide fiber springback resistance and irreversibly smooth surfaces which are substantially resistant to loss of smoothness upon rewetting, as for example in a subsequent surface sizing or coating process. Wet densification according to the present invention produces a web having greater density and increased internal bond strength, as compared with webs treated by conventionally known methods, to achieve the irreversibly smooth surfaces.

9 Claims, No Drawings

METHOD FOR PROVIDING ENHANCED SMOOTHNESS FOR A PAPER WEB

BACKGROUND OF INVENTION

The present invention is related to the manufacture of fine papers, including printing and writing papers, paperboard, and most particularly, to fine papers that are coated. For such products, printed smoothness is a significant characteristic which can yield a competitive advantage.

In the past, papermakers have used a number of different techniques to improve smoothness, including fiber selection and treatment, new forming methods, pressing, calendering, size press treatments, coating and finishing. It has also been found that a substantial improvement in smoothness can be achieved by pressing the paper web in a moist state, as for example, by press drying. An example of such a process is disclosed in the article, "The Hydra-Nip Dryer: The Easy Way to Surface Smoothness", by Marc Foulger, September 1988 *Tappi Journal,* pages 73–76. The same process is also disclosed in U.S. Pat. No. 4,596,633. The process is designed to achieve surface smoothness on paper comparable to the smoothness which can be obtained by calendering, without the degree of compaction of the web which occurs during calendering. Another method for achieving a smooth paper surface involves the densification of the paper rawstock. Wet densification adds strength and smoothness to the web, and increases the density of the web, while dry densification reduces the strength of the web while adding smoothness. However, the smoothness achieved by dry densification is partially lost due to rewetting of the web as, for example, in the size press or coaters. Examples of wet densification include U.S. Pat. No. 3,647,618, which discloses a method for densifying and smoothening a web while improving its formation by advancing the web at 18–40% moisture through a pressure nip formed between two covered rolls (which are slightly compressible and resilient); U.S. Pat. No. 3,124,504, which discloses a method for smoothening and glossing a paper web by passing the web at a moisture content of about 50% or less through a nip formed between a resilient roll and a heated finishing roll (soft calendering nip); U.S. Pat. No. 5,316,624, which discloses the soft calendering of a web using one hard roll and one soft roll at a moisture content of from about 15–55% to increase the density of the web by at least about 10% (soft calendering nip); and, British patent No. 522,196, which discloses a method for manufacturing coated paper from a consolidated and smoothened web wherein the web is passed through a nip formed between two chilled iron rolls (hard calendering nip) at a nominal pressure of about 700 psi at a moisture content of about 35–38%. However, none of the prior art is related to the specific results of wet densification achieved by the process of the present invention specifically, the use of a hard calendering nip at high pressure. In this context, U.S. Pat. No. 5,316,624 defines a hard calendering step as comprising passing a paper web between nipped rolls, the surface of each being formed of a hard, non-resilient material, and a soft calendering step as taking place between a pair of rolls wherein the surface of one roll is hard and non-resilient, while the surface of the opposed roll is made of a firm but resilient material, which is also referred to as supercalendering.

In accordance with the present invention, a process has been developed involving the smoothening, densification and consolidation of a paper web for achieving an improvement in smoothness that has heretofore not been recognized by the prior art. For the purpose of the present invention, smoothness refers to features on the surface of the paper ranging from obvious defects to those of the smallest size that can be discerned at reading distance by the unaided eye.

The Bekk smoothness test has been used to assess fine scale smoothness, and the Sheffield smoothness test to assess coarse scale smoothness.

With respect to the permanence of a smoothening treatment applied to a paper rawstock, at least two phenomena tend to undo smoothening treatments, namely springback or fiber puffing when a treated and dried web is subsequently rewetted during surface sizing or coating, and heat roughening which can occur when an overly moist web is rapidly dried, as for example, in a drying oven following heat set printing. In this context, a dried web is defined as a web which has been dried to a moisture content well known to those skilled in the art for the intended purpose. A method for overcoming heat roughening on the press involving the importance of controlled drying of the web after finishing to achieve a low moisture content entering the press is disclosed in U.S. patent application Ser. No. 07/953,254, filed Sep. 30, 1992 now U.S. Pat. No. 5,425,851, granted Jun. 20, 1995, entitled "Method for Improving the Printability of Web Offset Paper", owned by the present assignee herein. Another method for producing a smooth surface on a dried web by re-wet densification, which smoothness is retained upon rewetting, is disclosed in U.S. Pat. No. 5,378,497, granted Jan. 3, 1995, entitled "Method for Providing Irreversible Smoothness in a Paper Rawstock", also owned by the present assignee herein. This patent discloses a method for applying liquid to a paper web to achieve a non-uniform moisture content or moisture gradient in the Z-direction thickness of the web to a depth of less than about one-half the thickness of the web. However, the problem of achieving smoothness and reduced springback upon rewetting, during the paper manufacturing process, where the moisture in the web is substantially uniformly distributed, has not been previously addressed. Accordingly, it is an object of the present invention to provide a method and apparatus for smoothening, strengthening and densifying a paper web on a papermachine where the web has a substantially uniform moisture content, for the purpose of achieving superior smoothness, and for reducing fiber springback upon subsequent rewetting of the web.

SUMMARY OF INVENTION

It has been found according to the present invention, that increased densification and smoothness can be achieved by treating a paper web in a moist state to densify and strengthen the web and substantially eliminate the fiber springback that normally occurs when a dry-calendered web is rewetted, as for example, in a coating or surface sizing process. The wet densification treatment according to the present invention may be carried out on the papermachine before the web is completely dried, or at a location on the papermachine after the web is dried where the web is thoroughly rewetted before treatment. The wet densification process comprises treating the rawstock on the papermachine at a moisture content greater than about 20% and less than about 50%, and preferably from about 25–35% with a calender device at relatively high nip pressures greater than about 3000 psi, and preferably from about 3000–6000 psi.

It is known that if the moisture content of a paper web is increased at constant nip pressure, or if the nip pressure is increased at constant moisture content during calendering, both the smoothness and density of the web will increase for moisture contents less than about 20%. Unfortunately, these increases are not permanent, since upon rewetting the web in a subsequent coating or surface sizing process, springback of the fibers occurs, which impairs smoothness. However, according to the present invention, for moisture contents greater than about 20%, and nip pressures greater than about 3,000 psi, the bond strength of the web may be increased substantially by wet densification to achieve a surface where fiber springback is reduced. Thus, the smoothness achieved by wet densification according to the present invention is retained.

The mechanism underlying this discovery is believed to be based on a change in the nature of the fibers in the rawstock when the invention is practiced. As the moisture content of a cellulose fiber increases, the amorphous portions of the cellulose absorb more water and decrease in modulus making the fibers softer and more conformable. This process continues until the fibers become fully hydrated. With the increase in conformability, the pore structure and the fiber lumen become more able to collapse under pressure. However, as the moisture content is increased beyond about 20%, the volume of water present becomes significant in comparison to the residual pore volume. Thus, during calendering, the water cannot escape during the short dwell time in the calender nip, and thus acts to support the pores. At about 30% moisture content, the volume of water is greater than the pore volume which the fiber structure would support if the water could escape. The result is a totally softened fiber network which is limited in collapse. Touching fiber surfaces become easily deformed to achieve intimate contact over the entire contact region. Upon drying, the fibers stiffen in their low internal stress and flattened configuration. At the nip pressures and moisture contents disclosed herein, bond strength grows rapidly during drying because of the intimate fiber contacts and opportunities for hydrogen bonding. With a web so treated, rewetting causes little if any deformation or springback of the fibers, since the internal stresses are low and the bond strength is high. However, wet densification according to the present invention has little effect on smoothness after rewetting unless a rawstock density greater than about 13.5 lb/caliper point can be achieved. Above 13.5 lb/caliper point, internal bond and smoothness improve rapidly with increasing densification. Thus, according to the present invention, the calender load must be sufficient to produce a nip pressure to yield a density greater than about 13.5 lb/caliper point.

The smoothness of the paper web as measured by either the Bekk or Sheffield smoothness tests appears to be maximized at some point between about 10% and 20% moisture content, while internal bond of the web increases steadily with moisture increases up to about 30–35%, particularly at nip pressures higher than 3000 psi, and declines as moisture content goes higher than 35%. Thus, although a paper web wet densified at 30% moisture is not as smooth initially as paper densified at a lower moisture content, its smoothness is more permanent due to increased internal bond strength. Accordingly, the preferred moisture content of the web for practicing the present invention is about 25–35%, although satisfactory results may be obtained in excess of 35% moisture or less than 25% moisture, depending upon the type of rawstock and basis weight being treated, and the nip pressures used.

It is therefore an object of the present invention to provide a method and apparatus for improving the smoothness of a paper web, which may be subsequently coated, by wet densification during the paper making process.

Another object is to provide a method and apparatus for wet densifying a paper web during the papermaking process to produce a surface that is substantially unaffected by subsequent rewetting in a surface sizing or coating step.

These and other objects of the invention will become more apparent upon a careful consideration of the following detailed description of the invention.

DETAILED DESCRIPTION

Briefly stated, the present invention contemplates an apparatus and method for wet densification of a paper rawstock to produce a finished paper product with improved smoothness even after rewetting. For this purpose, in the preferred embodiment of the invention, the rawstock web is pressed in a calender device on the papermachine at a moisture content greater than about 20% and less than about 50%, and preferably 25–35%, at a nip pressure greater than about 3000 psi, and preferably between about 3000–6000 psi. A hard calender nip is preferred, with the use of a calender nip formed by rolls having hard non-resilient surfaces. These conditions provide rawstock web densities greater than about 13.5 lb/caliper point with unexpected increases in internal bond strength. The paper produced by the present invention is substantially unaffected by any subsequent coating or surface sizing treatment due to fiber debonding or springback. After coating, the paper may be finished to superior surface smoothness by conventional paper calendering, and to extraordinary smoothness by high temperature finishing.

EXAMPLE I

A preliminary experiment was conducted to establish the credibility of the present invention. The experiment was carried out using a single nip steel roll machine calender with one heated roll. The paper used was production basestock, rewetted to the desired moisture content. After wet densification, all conditions were dried to the same moisture content. Measurements were taken to show the increases in density achieved by wet densification and to observe the changes in smoothness achieved by increasing both the moisture contents and nip pressures beyond those normally used for smoothening paper webs. After drying, samples of the treated webs were then rewetted, to simulate a surface sizing or coating step, and then redried. Additional measurements were taken after redrying for both the density and smoothness to determine the effect on these characteristics produced by rewetting. The results are shown in Table I.

TABLE I

Wet Densification Effect on Springback

| Moisture (%) | Nip Pressure (psi) | Initial Density (lb/cal. pt) | Initial Bekk (sec) | Springback Density (lb/cal. pt) | Spring-back Bekk (sec) |
|---|---|---|---|---|---|
| 16 | 3,200 | 15.9 | 95 | 14.6 | 51 |
| 16 | 5,600 | 17.1 | 184 | 15.4 | 66 |
| 16 | 8,000 | 19.2 | 271 | 17.3 | 130 |
| 28.7 | 3,200 | 14.8 | 40 | 14.7 | 49 |
| 28.7 | 5,600 | 16.1 | 66 | 16.1 | 88 |
| 28.7 | 8,000 | 17.2 | 77 | 17.1 | 122 |

From the data shown in Table I, it may be seen that wet densification of a paper web at about 16% moisture, using nip pressures within the range of from about 3,000–8000 psi, produced Bekk smoothnesses of the web surface of 95–271 seconds Bekk, felt and wire (F/W) sides averaged. However, upon rewetting the samples treated at 16% moisture, the densities and smoothnesses obtained were reduced due to fiber springback to 51–130 seconds Bekk. Meanwhile, treatment of the paper web at about 28.7% moisture, at the same nip pressures, produced Bekk smoothnesses of 40–77 seconds. Nevertheless, upon rewetting and redrying the samples treated at 28.7% moisture, the smoothnesses increased to 49–122 seconds Bekk, with the greatest increases occurring at the higher pressures. Accordingly, this experiment demonstrated that for wet densification treatments of paper webs at higher moisture contents (e.g. greater than about 20%), the smoothness development achieved could be retained upon rewetting the web particularly at higher nip pressures.

Accordingly, the novelty of the present invention lies in the discovery that a paper web (rawstock) which is conditioned by wet densification at a uniform moisture content greater than about 20%, and at a nip pressure greater than about 3000 psi, is less likely to experience springback or roughening upon being rewetted and redried than a web treated at the same moisture content but at lower pressure.

EXAMPLE II

To illustrate this effect, and to observe the effect of wet densification according to the present invention on density, smoothness and internal bond at various moisture conditions, a paper rawstock was treated according to the present invention at high nip pressure. After treatment, the rawstock web was dried to a moisture content well known to one skilled in the art for further treatment, and all rawstock conditions were size pressed, pre-coat calendered, and coated with a standard coating formulation before being supercalendered, to observe the springback or roughening that might have occurred upon rewetting the web. Table II shows a progression of the paper properties from the rawstock through the size press and pre-coat calendered conditions.

TABLE II

| Wet Densification Effect on Density, Internal Bond and Smoothness | | | | |
|---|---|---|---|---|
| Condition | * | Density (lb/cal. pt) | Internal Bond | Bekk F/W |
| SOP CONTROL | A | 12.33 | 130 | 34/28 |
| 3.5% $H_2O$/2865 psi | B | 12.18 | 350 | 19/15 |
| | C | 13.34 | 350 | 51/33 |
| 3.5% $H_2O$/4880 psi | A | 14.48 | 122 | 92/103 |
| | B | 13.49 | 350 | 36/29 |
| | C | 14.59 | 350 | 89/64 |
| 7.5% $H_2O$/4880 psi | A | 14.73 | 139 | 117/116 |
| | B | 13.42 | 350 | 35/31 |
| | C | 14.64 | 350 | 70/53 |
| 9.5% $H_2O$/4880 psi | A | 15.73 | 157 | 141/143 |
| | B | 15.15 | 350 | 58/59 |
| | C | 15.19 | 350 | 84/71 |
| 19.5% $H_2O$/4880 psi | A | 16.13 | 261 | 135/151 |
| | B | 16.72 | 350 | 86/97 |
| | C | 17.25 | 350 | 125/129 |
| 28.0% $H_2O$/4880 psi | A | 16.32 | 283 | 96/101 |
| | B | 16.80 | 350 | 97/78 |
| | C | 17.27 | 350 | 116/120 |

*A = rawstock properties
B = properties after sizing
C = properties after sizing and precoat calendering
F/W = Felt/Wire sides of web
Internal Bond = Scott Internal Bond Test ($\times 10^{-3}$ ft-lb/in$^2$)

It will be noted from a consideration of the data in Table II that as the moisture content of the rawstock (condition A), was increased in the range of from 3.5–28.0%, at a constant nip pressure of 4880 psi, both density and internal bond increased, while the Bekk smoothness peaked for the condition at 9.5% moisture and remained substantially the same at the 19.5% moisture condition. Meanwhile the Bekk smoothness values after rewetting at the size press (condition B), were reduced at each moisture level as compared with condition A except at the 28.0% moisture content condition to achieve an irreversibly smooth surface where substantially all of the initial smoothness obtained by wet densification was retained. The data showing Bekk smoothness of the sized and pre-coat calendered webs (condition C) of Example II after coating and supercalendering are shown in Table III.

TABLE III

| Finished Paper Properties | | |
|---|---|---|
| CONDITION | Unprinted Bekk F/W | Printed Bekk F/W |
| SOP Control | 1391/961 | 1100/808 |
| 3.5% $H_2O$/4880 psi | 1229/873 | 919/615 |
| 7.5% $H_2O$/4880 psi | 1210/1032 | 1081/963 |
| 9.5% $H_2O$/4880 psi | 1705/1698 | 1413/1254 |
| 19.5% $H_2O$/4880 psi | 4780/4173 | 2782/2345 |
| 28.0% $H_2O$/4880 psi | 4798/4385 | 2567/2878 |

From the data in Table III, it will be seen that both the unprinted and printed Bekks were increased substantially by coating and supercalendering the wet densified webs. However, superior results were only obtained at moisture contents greater than 19.5%.

EXAMPLE III

In a second trial, the effect of wet densification by increasing the moisture content of the rawstock web beyond about 30% moisture was studied. In this study, the rawstock web was wet desified at moisture contents ranging from 29% to 44%, and then coated to effect a rewetting step. The results of the wet densification treatments are shown in Table IV, and Table V shows the benefits of wet densification after rewetting. Note that the best results were obtained at nip pressures greater than 3000 psi.

TABLE IV

| High Moisture Wet Densification (Rawstock) | | | | | |
|---|---|---|---|---|---|
| CONDITION | PRESSURE psi | MOISTURE % | INTERNAL BOND | DENSITY (lb/cal. pt.) | BEKK F/W |
| Control | — | 3 | 96 | 10.9 | 6/9 |
| 1 | 2580 | 29 | 126 | 13.9 | 25/31 |
| 2 | 3800 | 29 | 132 | 14.1 | 35/42 |
| 3 | 4000 | 29 | 128 | 14.2 | 29/34 |
| 4 | 2560 | 44 | 108 | 12.4 | 15/14 |
| 5 | 3800 | 43 | 112 | 12.5 | 20/18 |
| 6 | 4000 | 40 | 116 | 12.9 | 19/17 |

Internal Bond-Scott Internal Bond Test ($\times 10^{-3}$ ft-lbs/in$^2$)

TABLE V

| CONDITION | High Moisture Wet Densification (Coated) PRESSURE psi | MOISTURE % | COAT WEIGHT F/W | BEKK F/W |
|---|---|---|---|---|
| Control | — | 3 | 8.5/8.4 | 591/544 |
| 1 | 2580 | 29 | 7.8/7.6 | 956/918 |
| 2 | 3800 | 29 | 7.2/8.2 | 1087/1024 |
| 3 | 4000 | 29 | 7.7/7.6 | 1004/968 |
| 4 | 2560 | 44 | 7.8/7.8 | 770/714 |
| 5 | 3800 | 43 | 7.8/7.6 | 667/592 |
| 6 | 4000 | 40 | 7.3/7.5 | 879/794 |

By practicing the wet densification process of the present invention, critical levels of density, smoothness and fiber springback resistance (irreversible smoothness) can be achieved to produce a web that has superior smoothness after coating and finishing. Thus, while there are a number of basestock calendering methods which can be practiced to enhance paper smoothness, none achieves the same retention of smoothness after rewetting as the wet densification process described herein.

Contrary to most accepted theories for achieving finished paper smoothness, the present invention achieves the desired objectives by treating the rawstock web in a calender device at nip pressures greater than those that would normally be used within the moisture range specified. The result is the production of a rawstock suitable for sizing or coating that does not experience the fiber puffing or springback effect that one skilled in the art might expect.

The cellulosic material which is useful as a starting material for the paper rawstock of the present invention may be chemical, semi-chemical or mechanical pulp derived from any species of pulp wood including mixtures thereof. Accordingly, while the foregoing specification includes a complete description of a preferred embodiment of the present invention in considerable detail, various other embodiments and modifications will occur to those skilled in the art, within the scope of the appended claims. For example, applying heat to one or both of the rolls during the wet densification process would be within the knowledge of one skilled in the art and within the scope of the appended claims.

What is claimed is:

1. A method for densifying, strengthening and smoothening a web of paper on a papermachine comprising:

(a) producing a paper web from a fibrous papermaking furnish on a papermachine;

(b) removing water from the furnish to achieve a wet fibrous web having a uniform moisture content greater than about 20% and less than about 50%;

(c) advancing the wet fibrous web of step (b) through at least one hard nip of a calender device formed by calender rolls each having non-resilient surfaces; and, (d) drying the treated web, wherein the pressure in the nip of the calender device of step (c) is about 3000–6000 psi to provide a web having a density greater than about 13.5 lb/caliper point to achieve web surfaces that are substantially resistant to loss of smoothness upon rewetting.

2. The method of claim 1 wherein the moisture content of step (b) is greater than about 25% and less than about 45%.

3. The method of claim 1 wherein the moisture content of step (b) is in the range of from about 25–35%.

4. The method of claim 1 wherein the nip pressure is within the range of about 4000–5000 psi.

5. The method of claim 1 wherein the nip of the calender device is formed from a pair of steel rolls.

6. A method for densifying, strengthening and smoothening a web of paper on a papermachine comprising:

(a) producing a paper web from a fibrous papermaking furnish on a papermachine;

(b) removing water from the web to produce a rawstock web suitable for coating or surface sizing;

(c) rewetting the web to substantially thoroughly saturate the web and achieve a uniform moisture content greater than about 20% and less than about 50%;

(d) advancing the web at the moisture content of step (c) through at least one hard nip of a calender device formed by calender rolls having non-resilient surfaces wherein the nip pressure is about 3,000–6000 psi; and, (e) drying the web to provide a web having a density greater than about 13.5 lb/caliper point to achieve web surfaces that are substantially resistant to loss of smoothness upon surface sizing or coating.

7. The method of claim 6 wherein the web is rewetted in step (c) to a moisture content of between about 25–35%.

8. The method of claim 6 wherein the nip of the calender device is formed from a pair of steel rolls.

9. The method of claim 6 wherein the nip pressure of step (d) is within the range of from about 4000–5000 psi.

* * * * *